US009717271B2

(12) United States Patent
Gambs et al.

(10) Patent No.: US 9,717,271 B2
(45) Date of Patent: Aug. 1, 2017

(54) FILTER SEGMENT COMPRISING AN ACETATE SALT AND GLYCERINE

(71) Applicant: PHILIP MORRIS PRODUCTS S.A., Neuchatel (CH)

(72) Inventors: Celine Gambs, Cham (CH); Irfan Gunduz, Le Mont-sur-Lausanne (CH); Ping Li, Lausanne (CH); Roger Hofer, Peseux (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/434,133

(22) PCT Filed: Oct. 21, 2013

(86) PCT No.: PCT/EP2013/071976

§ 371 (c)(1),
(2) Date: Apr. 8, 2015

(87) PCT Pub. No.: WO2014/064052

PCT Pub. Date: May 1, 2014

(65) Prior Publication Data

US 2015/0289562 A1 Oct. 15, 2015

(30) Foreign Application Priority Data

Oct. 22, 2012 (EP) ..... 12189483

(51) Int. Cl.
*A24D 3/14* (2006.01)
*A24D 3/10* (2006.01)

(52) U.S. Cl.
CPC *A24D 3/14* (2013.01); *A24D 3/10* (2013.01)

(58) Field of Classification Search
CPC ..... A24D 3/10; A24D 3/14
USPC ..... 131/345
See application file for complete search history.

(56) References Cited

U.S. PATENT DOCUMENTS

| | | | | |
|---|---|---|---|---|
| 3,429,318 A * | 2/1969 | Walker | A24D 3/14 | 131/331 |
| 2005/0211260 A1* | 9/2005 | Sasaki | A24D 3/14 | 131/334 |
| 2012/0118309 A1* | 5/2012 | Taniguchi | A24D 3/14 | 131/342 |
| 2015/0183725 A1* | 7/2015 | Oguchi | C07C 227/40 | 562/554 |

FOREIGN PATENT DOCUMENTS

| | | |
|---|---|---|
| CA | 818206 | 7/1969 |
| DE | 3150582 | 6/1983 |
| EP | 1541043 | 3/2014 |
| KZ | 25499 | 2/2012 |
| UA | 78604 | 4/2007 |

OTHER PUBLICATIONS

"What is Acetate", www.study.com, Aug. 24, 2016.*
"Acidic and Basic Amino Acids", www.chem.wisc.edu, Sep. 1, 2016.*
"Acidic and Basic Salt Solutions", www.chem.purdue.edu, Sep. 1, 2016.*
European Extended Search Report for Application No. 12189483.6 dated Mar. 19, 2013 (5 pages).
PCT Search Report and Written Opinion for PCT/EP2013/071976 dated Feb. 21, 2014 (7 pages).
Office Action issued in Kazakhstan for Application No. 2015/0687 dated Oct. 27, 2016 (5 pages). English translation included.
Office Action issued in Ukraine for Application No. 2015 4096 dated Feb. 24, 2017 (11 pages). English translation included.

* cited by examiner

*Primary Examiner* — Alison L Hindenlang
*Assistant Examiner* — Jamel M Nelson
(74) *Attorney, Agent, or Firm* — Mueting, Raasch & Gebhardt, P.A.

(57) ABSTRACT

A smoking article comprising a filter segment, the filter segment comprising a tow material and triacetin, wherein the filter segment further comprises an amino acid acetate salt and glycerine. The amino acid acetate salt and glycerine stabilize the triacetin in order to maintain the structural firmness of the tow material.

20 Claims, No Drawings

FILTER SEGMENT COMPRISING AN ACETATE SALT AND GLYCERINE

This application is a U.S. National Stage Application of International Application No. PCT/EP2013/071976, filed Oct. 21, 2013, which was published in English on May 1, 2014 as International Patent Publication WO 2014/064052 A1. International Application No. PCT/EP2013/071976 claims priority to European Application No. 12189483.6 filed Oct. 22, 2012.

The present invention relates to a filter segment comprising an amino acid acetate salt and glycerine for use in a filter of a smoking article and to a filter and a smoking article comprising such a filter segment.

Filter cigarettes generally comprise a rod of tobacco cut filler surrounded by a paper wrapper and a cylindrical filter aligned in end-to end relationship with the wrapped tobacco rod and attached thereto by tipping paper.

In conventional filter cigarettes, the filter may consist of a single segment of filtration material, typically cellulose acetate tow, wrapped in porous plug wrap. Alternatively, the filter may be a multi-segment filter comprising two or more segments of filtration material for the removal of particulate and gaseous components of the mainstream smoke.

During the production of the filter, a tow material is pulled from a supply as a running web and is treated. The filter tow is made of a woven material of threads loosely adhering to one another which are pulled apart in order to form a wide and mostly level web such that the threads are moved next to one another and essentially parallel. The web is expanded in an expander nozzle. Typically the tow material is cellulose acetate. Following the expansion, an additive is supplied to the web in finely dispersed form. This additive is typically liquid and formed of droplets of triacetin. The droplets start to dissolve the threads such that the threads permanently stick together. The threads are then gathered to form a cylindrical rod and encased with a filter plug wrap.

Whilst triacetin helps keep the tow material together, there remains the desire to improve the stability of triacetin so that it maintains the structure of the tow material for even longer. This results in a filter segment having better structural rigidity or firmness which is desirable for consumers. Furthermore, stabilising triacetin avoids producing other compounds that could give an unexpected sensorial impact on mainstream smoke.

According to the present invention there is provided a filter segment for use in a filter of a smoking article, the filter segment comprising a tow material and triacetin, wherein the filter segment further comprises an amino acid acetate salt and glycerine.

The invention further provides the use of an amino acid acetate salt and glycerine in a filter segment comprising a tow material and triacetin to stabilise the triacetin. The use results in a tow material that maintains its structural rigidity or firmness.

The invention also provides a method of preparing a filter segment comprising applying triacetin to a tow material, applying an aqueous solution of an amino acid acetate salt and glycerine to the tow material and forming a filter segment from the resulting tow material.

As used herein, the term 'filter segment' is used to describe a segment for use in a filter. Use of the term 'filter segment' does not signify that the segment has significant filtration effect. It will be appreciated that filter segments according to the invention may have little or substantially no filtration effect.

Filter segments according to the invention may advantageously be used in filters for filter cigarettes and other smoking articles in which material is combusted to form smoke. Filter segments according to the invention may also be used in smoking articles in which material is heated, rather than combusted. In one type of heated smoking article, tobacco material or another aerosol forming material is heated by one or more electrical heating elements to produce an aerosol. In another type of heated smoking article, an aerosol is produced by the transfer of heat from a combustible fuel element or heat source to a physically separate aerosol forming material, which may be located within, around or downstream of the heat source.

The triacetin is typically applied on a tow material, for example a cellulose acetate tow material, at about 5% to about 10% by weight, based on the total weight of the tow material. It is used to bind the cellulose acetate fibres together and provides firmness and structural integrity to the filter that is desirable to consumers. The triacetin is preferably present in an amount of from about 10 mg to about 65 mg, more preferably from about 15 mg to about 60 mg.

The amount of triacetin can be calculated using standard gas chromatographic analysis, such as described in Coresta Recommended Method No. 59 (June 2004).

It has been found that the amino acid acetate salt can improve the stability of triacetin which, in turn, helps maintain the structural integrity of the tow material for longer. Preferably the amino acid acetate salt is present in an amount of from about 1 mg to 15 mg. More preferably, the amino acid acetate salt is present in an amount of from about 4 mg to about 12 mg. Below about 1 mg, the amino acid acetate salt does not adequately stabilise the triacetin whereas above about 15 mg the amino acid acetate salt can generate a slightly bitter taste.

Preferably, the amino acid acetate salt is lysine acetate.

The filter segment further comprises glycerine. Glycerine, in combination with the amino acid acetate salt, further improves the stability of the triacetin.

The amount of glycerine is preferably between about 10 mg and about 25 mg, more preferably between about 12 mg and about 20 mg.

The amounts of the amino acid acetate salt and glycerine can be calculated using standard gas chromatographic analysis.

The filter segment is preferably wrapped in a filter plug wrap. The term "filter plug wrap" is commonly used in the tobacco industry to describe the wrapper surrounding the filter rod of a filter cigarette. Filter plug wrap is commercially available from a large number of suppliers.

Whilst any commercially available filter plug wrap may be used with the filter segment, it has been found that filter plug wrap having an air permeability of between about 6000 Coresta units and about 24000 Coresta units as measured in accordance with ISO 2965:2009, is desirable.

Filter plug wrap having an air permeability of between about 6000 Coresta units and about 24000 Coresta units has excellent liquid absorption capability. Without wishing to be being bound by theory, the open structure of such filter plug wrap enables it to absorb large quantities of liquid.

Preferably, filter plug wrap for use in the present invention has a sufficiently high tensile strength to resist breakage during the manufacture of filter segments according to the invention. More preferably, filter plug wrap for use in the present invention has a tensile breaking strength of at least about 20 N/15 mm at a constant rate of elongation of 8 mm/min for a sample width of 15 mm, as measured in accordance with the principles set out in ISO 1924-2:2008.

Filter plug wrap for use in the present invention is preferably made from pulp comprising a mixture of short and long fibres. Short fibres include, but are not limited to: hardwood fibres such as aspen, beech, birch, chestnut, eucalyptus, gum, maple, oak, poplar and walnut. Long fibres include, but are not limited to: softwood fibres such as, for example, cedar, fir, pine, redwood and spruce; and non-wood fibres such as abaca, flax, hemp, kenaf and sisal.

Preferably, filter plug wrap for use in the present invention is made from pulp comprising between about 60% to about 90% by weight of softwood fibres (such as, for example, cedar, fir, pine, redwood, spruce and mixtures thereof), between about 10% to about 40% by weight of hardwood fibres (such as, for example, aspen, beech, birch, chestnut, eucalyptus, gum, maple, oak, poplar, walnut and mixtures thereof) and between about 0% and about 40% by weight of non-wood fibres (such as, for example, abaca, flax, hemp, kenaf, sisal and mixtures thereof).

Filter plug wrap suitable for use in the present invention is known in the art and commercially available from a large number of suppliers.

The tow material is loaded with an amino acid acetate salt and glycerine.

The tow material may be loaded with at least one liquid smoke-modifying agent by, for example, dipping, spraying or otherwise applying the at least one liquid smoke-modifying agent to the tow material.

As used herein, the term smoke-modifying agent is used to describe any agent that, in use, modifies one or more features or properties of mainstream smoke passing through the filter segment. Suitable smoke-modifying agents include, but are not limited to, agents that, in use, impart a taste or aroma to mainstream smoke passing through the filter segment and chemesthetic agents. For example, the tow material may be loaded with one or more liquid flavourants.

Preferably, the filter segment has a resistance to draw (RTD) of between about 40 mm WG and about 100 mm WG, more preferably a resistance to draw of about 70 mm WG as measured in accordance with ISO 6565:2002.

Preferably, the length of the filter segment is between about 5 mm and about 22 mm, more preferably between about 8 mm and about 18 mm, most preferably about 15 mm.

In certain embodiments the filter segment has a diameter of between about 0.5 mm and about 3 mm.

Filter segments according to the invention may be produced using existing methods and apparatus for forming known filter segments for filters for smoking articles.

According to the invention, there is also provided a filter for a smoking article comprising a filter segment according to the invention.

As used herein, the term 'filter' is used to describe a mouthpiece for a smoking article. Use of the term 'filter' does not signify that the filter has significant filtration effect. It will be appreciated that filters according to the invention may have little or substantially no filtration effect. This is particularly the case for filters according to the invention for use in heated smoking articles of the types previously described above or other non-combustible smoking articles.

Preferably, the external diameter of filters according to the invention is between about 4.5 mm and about 8.5 mm, more preferably between about 7.7 mm and about 8.1 mm, most preferably about 7.9 mm.

Preferably, the overall length of filters according to the invention is between about 17 mm and about 36 mm, more preferably between about 24 mm and about 30 mm, most preferably about 27 mm.

Preferably, the overall encapsulated resistance to draw (RTD) of filters according to the invention is between about 100 mm WG (water gauge) and about 180 mm WG as measured in accordance with ISO 6565:2002.

Filters according to the invention may be single segment filters.

Alternatively, filters according to the invention may be multi-segment filters comprising a filter segment according to the invention and at least one additional filter segment.

Multi-segment filters according to the invention may include one or more additional filter segments according to the invention or one or more additional filter segments not according to the invention or any combination thereof.

Multi-segment filters according to the invention may include one or more additional filter segments upstream of the filter segment according to the invention. Alternatively or in addition, multi-segment filters according to the invention may include one or more additional filter segments downstream of the filter segment according to the invention.

Throughout the specification, the terms 'upstream' and 'downstream' are used to describe the relative positions of components of filters according to the invention in relation to the direction of mainstream smoke drawn through the filters during use thereof.

Multi-segment filters according to the invention preferably comprise a filter segment according to the invention at the mouth end thereof (that is at the downstream end of the multi-segment filter). The filter segment according to the invention may comprise one or more coloured threads or other coloured elongate substrates of substantially the same length as the filter segment. The downstream ends of the one or more coloured elongate substrates at the mouth end of the multi-segment filter are preferably visible to a consumer. The colour of the substrates may be used to indicate to a consumer the type of smoke-modifying agent with which the substrates are loaded.

Preferably, the length of each individual filter segment of multi-segment filters according to the invention is between about 5 mm and about 22 mm, more preferably between about 8 mm and about 18 mm, most preferably about 15 mm.

Multi-segment filters according to the invention may include additional filter segments comprising, for example, one or more filtration materials, one or more sorbents, one or more catalysts, one or more flavourants or any combination thereof.

Suitable sorbents for inclusion in additional filter segments of multi-segment filters according to the invention are known in the art and include, but are not limited to, activated carbon, activated alumina, zeolites, molecular sieves, silica gel and combinations thereof.

Suitable catalysts for inclusion in additional filter segments of multi-segment filters according to the invention are known in the art and include, but are not limited to, catalysts for the conversion of carbon monoxide in mainstream smoke to carbon dioxide and catalysts for the conversion of nitric oxide in mainstream smoke to nitrogen such as, for example, iron oxide and copper oxide.

Suitable flavourants for inclusion in additional filter segments of multi-segment filters according to the invention are known in the art.

The filter segment may consist of a hollow tube or recess located at the mouth end of the multi-segment filter that has substantially no filtration efficiency. Where the mouth end filter segment is a hollow tube or recess, the mouth end filter segment may be formed when the filter is attached to, for example, a rod of smokable material by tipping paper to form a combustible smoking article.

Preferably, the length of a mouth end filter segment is between about 3 mm and about 12 mm, more preferably between about 6 mm and about 8 mm. Where the mouth end filter segment comprises a hollow tube or recess, the length of the mouth end filter segment is preferably between about 3 mm and about 6 mm.

Preferably, the mouth end filter segment has a resistance to draw of about 20 mm WG or less as measured in accordance with ISO 6565:2002.

A mouth end filter segment may advantageously be included downstream of the filter segment according to the invention to balance the overall resistance to draw of filters according to the invention in order to achieve a desired overall resistance to draw for a smoking article comprising the filter. For example, where the mouth end filter segment comprises a plug of cellulose acetate tow, the denier per filament and total denier of the tow may be selected in order to achieve a desired overall resistance to draw for the multi-segment filter. Preferably, where the mouth end filter segment comprises a plug of cellulose acetate tow, the cellulose acetate tow has a denier per filament of about 5 or more.

Filters according to the invention may be particularly advantageously used as filters for "low tar" filter cigarettes, and in particular "low tar" ventilated filter cigarettes, having a total nicotine free dry particulate matter (NFDPM) or "tar" delivery of between about 4 mg and about 6 mg and "ultra low tar" filters cigarettes having a total nicotine free dry particulate matter (NFDPM) or "tar" delivery of about 3 mg or less.

However, it will be appreciated that the filters may be used as filters for filter cigarettes and other smoking articles having a higher total nicotine free dry particulate matter (NFDPM) or "tar" delivery, for example a total nicotine free dry particulate matter (NFDPM) or "tar" delivery of about 6 mg or more.

According to the invention there is also provided a smoking article comprising a filter according to the invention.

Preferably, smoking articles according to the invention have an overall length of between about 68 mm and about 128 mm, more preferably about 84 mm.

Smoking articles according to the invention may be combustible smoking articles comprising a wrapped rod of smokable material and a filter according to the invention.

Preferably, the smokable material is tobacco cut filler.

Preferably, the rod of smokable material is wrapped in cigarette paper.

Preferably, the filter is attached to the rod of smokable material by tipping paper. The tipping paper may be transparent along at least a portion of its length.

Combustible smoking articles according to the invention preferably further comprise at least one circumferential row of perforations at a location along the filter in order to ventilate mainstream smoke drawn through the filter from the rod of smokable material by a consumer.

Preferably, the at least one circumferential row of perforations is located at least 12 mm from the mouth end of the filter.

Preferably, combustible smoking articles according to the invention have a ventilation of between about 40% and about 80%, more preferably a ventilation of about 70% as measured in accordance with ISO 9512:2002.

Preferably, ventilated combustible smoking articles according to the present invention have a resistance to draw (RTD) of between about 60 mm WG and about 110 mm WG as measured in accordance with ISO 6565:2002.

Preferably, combustible smoking articles according to the invention have a total nicotine free dry particulate matter (NFDPM) or "tar" delivery of between about 0.2 mg and about 12 mg, more preferably of between about 4 mg and about 10 mg, most preferably of about 7 mg or less.

Smoking articles according to the invention may alternatively be non-combustible smoking articles. For example, smoking articles according to the invention may be heated smoking articles of the types previously described above.

EXAMPLE

Various solutions comprising L-lysine acetate are prepared as shown in the following table by simple mixing of the ingredients with stirring. Unless otherwise indicated, the amounts denote % by weight based on the total weight of the solution.

| | Solution | | | |
|---|---|---|---|---|
| | I | II | III | IV |
| Water | 50 | 40 | 40 | 23 |
| Glycerine | 25 | 40 | 30 | 46 |
| Lysine Acetate | 25 | 20 | 30 | 31 |
| Viscosity at 20° C. (Centipoise) | 3 | 6 | 4 | 11 |
| Density at 20° C. (g/mL) | 1.12 | 1.12 | 1.12 | 1.13 |

The solutions are sprayed onto a standard cellulose tow web immediately after triacetin has been applied to the tow. The method of application is standard and well known in the art.

The strands of tow are brought together and a filter plug wrap is placed around the tow. The tow is then cut to form filter segments. The filter segments are then allowed to dry over a period of 7 days and stored in containers. Separately a standard cellulose acetate filter segment is prepared that does not contain any lysine acetate or glycerine. It is also allowed to dry over a period of 7 days. The filter segments are then placed in a closed container in which the atmosphere inside the container is controlled to maintain a relative humidity of 80% and a temperature of 20° C. After 2 weeks, the standard filter segment shows significant reduction in the amount of triacetin. In contrast, the filter segments comprising the lysine acetate and glycerine show hardly any reduction in the amount of triacetin.

While the invention has been exemplified above with reference to combustible smoking articles, it will be appreciated that filter segments according to the invention may also be used in filters for non-combustible smoking articles.

The invention claimed is:

1. A filter segment comprising a tow material and triacetin, wherein the filter segment further comprises an amino acid acetate salt and glycerine.

2. A filter segment according to claim 1 wherein the amino acid acetate salt is lysine acetate.

3. A filter segment according to claim 1 wherein the amino acid acetate salt is present in an amount between 1 mg and 15 mg.

4. A filter segment according to claim 1 wherein the amino acid acetate salt is present in an amount between 4 mg and 12 mg.

5. A filter segment according to claim 1 wherein the glycerine is present in an amount between 10 and 25 mg.

6. A filter segment according to claim 5 wherein the glycerine is present in an amount between 12 and 20 mg.

7. A filter segment according to claim 1 wherein the filter segment has a diameter of between 0.5 mm and 3 mm.

8. A filter segment according to claim 1 wherein the tow material comprises cellulose acetate.

9. A filter comprising a filter segment according to claim 1.

10. A multi-segment filter comprising a filter segment according to claim 1 and one or more additional filter segments.

11. A smoking article comprising a filter segment according to claim 1.

12. A method comprising combining an amino acid acetate salt and glycerine in a filter segment comprising a tow material and triacetin to stabilise the triacetin.

13. The method according to claim 12 wherein the combining step maintains the structural rigidity or firmness of the tow material in the filter segment.

14. A method of preparing a filter segment comprising applying triacetin to a tow material, applying an aqueous solution of an amino acid acetate salt and glycerine to the tow material and forming a filter segment from the resulting tow material.

15. A filter segment according to claim 2 wherein the amino acid acetate salt is present in an amount between 1 mg and 15 mg.

16. A filter segment according to claim 3 wherein the glycerine is present in an amount between 10 and 25 mg.

17. A filter segment according to claim 4 wherein the glycerine is present in an amount between 10 and 25 mg.

18. A filter segment according to claim 15 wherein the glycerine is present in an amount between 12 and 20 mg.

19. The method according to claim 14, wherein the amino acid acetate salt comprises lysine acetate.

20. The method according to claim 19, further comprising combining the filter segment with a rod of smokable material to form a smoking article.

* * * * *